US006152802A

United States Patent [19]

Horta et al.

[11] Patent Number: 6,152,802

[45] Date of Patent: Nov. 28, 2000

[54] ELONGATED FLEXIBLE TIP FOR BRASSIERE FRAMES

[75] Inventors: Joseph Horta, Yonkers; Vladimir Barmas, Brooklyn, both of N.Y.

[73] Assignee: S&S Industries, Inc., New York, N.Y.

[21] Appl. No.: 09/329,097

[22] Filed: Jun. 9, 1999

[51] Int. Cl.[7] ..... A41C 1/14

[52] U.S. Cl. ..... 450/48; 450/52

[58] Field of Search ..... 450/41–43, 45–54, 450/92, 93; 2/255, 256, 257–259, 260, 260.1, 261, 264

[56] References Cited

U.S. PATENT DOCUMENTS

| | | |
|---|---|---|
| 2,463,319 | 3/1949 | Schwartz . |
| 3,605,753 | 9/1971 | Schwartz . |
| 3,998,231 | 12/1976 | Delet . |
| 4,201,220 | 5/1980 | Rowell . |
| 4,271,580 | 6/1981 | King et al. . |
| 4,275,740 | 6/1981 | Weston . |
| 4,770,650 | 9/1988 | Rowell . |
| 4,777,668 | 10/1988 | Weston . |
| 5,141,470 | 8/1992 | Morgan et al. . |
| 5,527,202 | 6/1996 | Morgan et al. . |
| 5,830,040 | 11/1998 | Morgan et al. . |

*Primary Examiner*—Gloria M. Hale
*Attorney, Agent, or Firm*—Abelman, Frayne & Schwab

[57] ABSTRACT

A breast support frame for brassieres is disclosed which includes an elongated flexible tip at each of its ends. The elongated flexible tip is configured to provide increased flexibility and softness and thereby enhance the comfort to the wearer. The tip includes an enlongated distal portion which freely extends beyond the insertion of the end of the U-shaped resultant stiffening member within the tip. The distal portion is preferably tapered and narrowed to further enhance its flexibility.

18 Claims, 3 Drawing Sheets

ELONGATED FLEXIBLE TIP FOR BRASSIERE FRAMES

FIELD OF THE INVENTION

The present application relates to the breast supporting frame for brassieres, and more particularly to an improvement in the cushioned end tips secured thereto.

BACKGROUND OF THE INVENTION

One type of well known brassiere, termed an underwire, includes a resilient stiffening member which comprises a generally U-shaped portion that is positioned beneath the breast cup in order to provide increased breast support. The resilient stiffening member is usually placed within an arcuate brassiere pocket which extends along the bottom of the breast cup. The resilient stiffening member may typically be formed of steel having a rectangular cross section. The ends of the arcuate underwire, one of which will generally be along the side of the breast, are stiff and may include sharp corners. Since the ends of the underwire can be pressing against the wearer, particularly along a sensitive portion of the wearer's body, it is well known to provide a softening tip, usually formed of a plastic, at the ends of the wire. The need for such a softening tip is particularly critical should an end of the underwire poke through the undercup brassiere pocket which is intended to contain the underwire, with such a condition tending to occur after repeated machine washings of the brassiere. The prior art, typically exemplified by the assignee's of the present invention U.S. Pat. Nos. 5,830,040, 3,777,763, 3,599,643, and 4,133,316, includes such plastic tips to effectively provide greater comfort to the wearer. While such plastic tips have achieved substantial commercial and wearer acceptance, providing long term comfortable support, we have recognized the desirability of further enhancing the comfort of such tips by increasing their flexibility in a simple and extremely cost effective manner.

SUMMARY OF THE INVENTION

The present invention relates to an improvement in the separately molded plastic tip members that are secured to the ends of a U-shaped brassiere underwire. The tip members are secured to the ends of the wire by cooperating (a) projections at the end of the wire (which may be in the form of a tang, or laterally extending barbs), and (b) an aperture within the tip which is intended to securely receive the wire projections for effectively retaining a tip on each end of the wire. The tip includes an aperture of a desired length which is adapted to receive the end of the wire, with the length of the aperture naturally defining the length of wire that extends into the tip in order to provide a secure engagement therebetween. Cantilevered outward, distally beyond the location of the wire end within the tip, is a length of the plastic material forming the tip which provides cushioning beyond the end of the wire. In the past this free end, or distal portion, of the tip has been relatively short, typically significantly less than the length of the underwire extending into the proximate end of the tip. For example, in prior art tips, the end of the wire may typically extend into the tip approximately 0.4 inches, with the distal freely extending cushioning portion of the tip typically only being in the order of 3/16ths to ¼ inch. The relatively short length of plastic material in the prior tips which extends beyond the rigidification provided by the end of the wire within the tip, while providing substantial cushioning compared to a wire which does not include a tip, limits the degree of overall cushioning achieved by the addition of the tip.

In accordance with the present invention, the distal end of the tip is significantly extended and tapered beyond the insertion of the underwire therein. In particular, the distal portion of the tip which extends beyond the end of the wire is preferably longer than the length of wire inserted within the tip. For example, wherein previously this freely extending distal portion was in the order of 3/16ths to ¼ inch, we presently contemplate a distal portion which may exceed 0.4 inches. This increased length of the distal portion has been found to provide several advantages. It extends the bending point of the tip beyond the insertion of the metal wire. This results in a substantially more flexible, and hence softer, tip construction. As a further advantage, the increased length of the distal portion (which does not include the metal underwire) facilitates sewing through the end of the tip so as to keep the entire underwire within the brassiere pocket, thereby minimizing underwire poke through should the pocket be subsequently torn. Thus, in addition to increasing the comfort to the wearer such retention of the underwire in a torn pocket advantageously increases the wear life of the brassiere.

To further enhance the flexibility and hence softness of the brassiere tip, a substantial length of the distal portion is of a reduced cross section, which may be in the order of one-half the cross section at the proximate end of the tip. In order to provide a smooth transition between the proximate and distal ends, a medial tapered section is provided.

Accordingly it is a primary object of the present invention to provide a breast support frame for brassieres which includes end tips which are configured for increased softness and wearer comfort.

A further object of the present invention is to provide such a breast support frame which includes elongated flexible end tips.

Another object of the present invention is to provide such a breast support frame in which the end tips are formed of a soft plastic material, and include a freely extending distal portion of a length greater than the length of the underwire inserted within the proximate end of the tip.

Yet a further object of the present invention is to provide such a breast support frame wherein the plastic material at the distal end of the tip is in the order of one-half the thickness of the plastic material at its proximate end.

Yet another object of the present invention is to provide such a breast support frame having end tips which taper between their proximate and distal ends so as to significantly decrease the thickness of the proximate portion of the tip.

These as well as other objects of the present invention will become apparent upon a consideration of the following drawings and description:

DETAILED DESCRIPTION OF THE PREFERRED EMBODIMENTS

Figure 1:
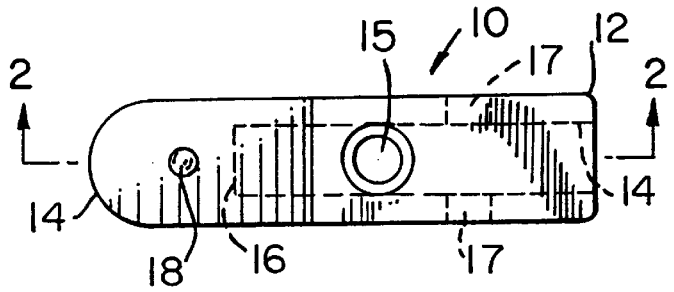
FIG. 1 PRIOR ART
FIG. 1 is a top view of a typical prior art end tip.
Figure 2:
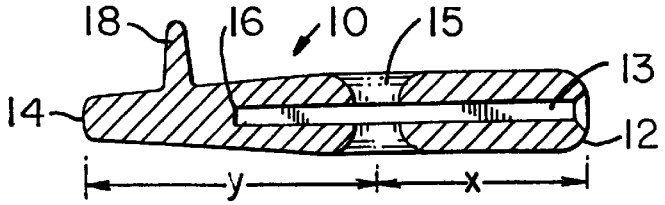
FIG. 2 PRIOR ART
FIG. 2 is a cross sectional view along the line 2—2 as shown in FIG. 1 and looking in the direction of the arrows.

Reference is initially made to FIGS. 1 and 2 which show a typical prior art tip 10 which is intended to be secured to the ends of a generally U-shaped resilient stiffening member such as 100 or 110 of FIGS. 6–11. Tip 10 includes a proximate end 12 and distal end 14. Proximate end 12 includes an aperture 14 which is intended to receive the end of the arcuate resilient stiffening member (100 or 110 not shown in FIGS. 1 or 2) and terminates at shoulder 16. In order to provide a secure engagement therebetween, the tip includes either (or both) aperture 15 or diametrically opposed apertures 17. Aperture 15 is intended to receive a locking tang projection 102 (see FIGS. 6–8) in the well known manner. Alternatively apertures 17 are intended to receive laterally extending barbs 103, as shown by the U-shaped resilient stiffening member of FIGS. 9–11. While either tang 102, or barbs 103, are provided at the ends of the resilient stiffening member, tip 10 preferably includes both apertures 15 and 17 so as to accommodate either resilient stiffening member constructions 100 or 110. Also, in the well known manner, a locating projection 18 may also be provided on the separately molded tip 10 to facilitate the assembly of the tip 10 on the ends of the resilient stiffening member 100 or 110. Projection 18 is then removed after such assembly.

Tip 10 is preferably molded of a soft plastic material which may typically be of low density polyethylene. In the typical prior art tip construction, as shown in FIGS. 1 and 2, the length of aperture 14 for receiving the end of the resilient stiffening member, as shown by X in FIG. 2, may be in the order of 0.4 inches. In the past this length has been greater than the length of the freely extending distal portion, shown as Y. Length Y may typically have been in the order of only 3/16ths to ¼ of an inch. Thus when the end of the tip 10 is flexed, its bending moment will tends to hinge about a location within length X. The insertion of the end of the resilient stiffening member limits the flexibility provided by the distal end of tip 16.

Figure 3:
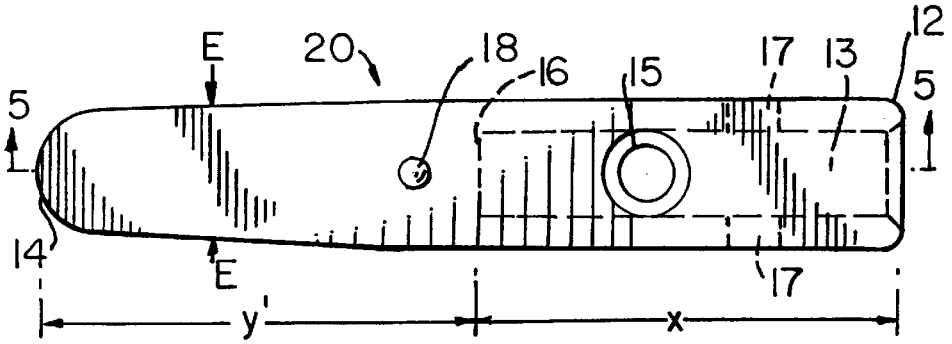
FIG. 3 is a top view of an end tip in accordance with the present invention.
Figure 4:
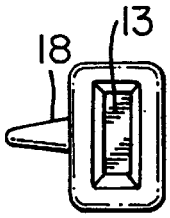
FIG. 4 is an end view of FIG. 3.
Figure 5:
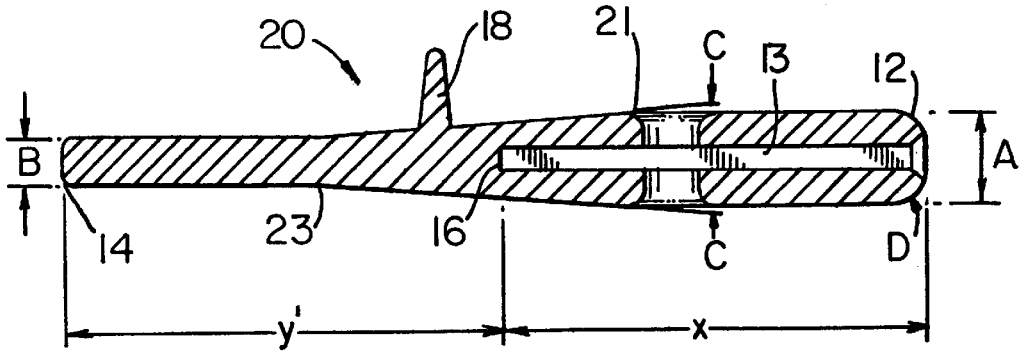
FIG. 5 is a cross sectional view of FIG. 3 along the line shown as 5—5 and looking in the direction of the arrows.

Reference is now made to FIGS. 3–5 which show tip 20 constructed in accordance with the present invention, and in which those components corresponding to FIGS. 1 and 2 are indicated by like numerals.

It should initially be noted that whereas the length of aperture 13 from the proximate end 12 to shoulder 16 may correspond to the prior art, and is indicated by distance X, the freely extending distal portion shown by length Y' is now significantly longer than length Y of FIGS. 1 and 2, and may even preferably exceed length X. Whereas previously the distal portion shown by length Y was in the order of 3/16ths to ¼ of an inch, length Y' will exceed ¼ of an inch, and, preferably, may even exceed 0.4 inches. To further enhance the flexibility of the distal portion shown in FIGS. 3–5, the tip includes a medial tapered section between the points 21 and 23. This medial tapered portion narrows the cross section between that shown as A, at the proximate end 12, and B at the distal end 14. Thickness B may preferably be in the order of ½ the thickness of A. Projecting beyond the distal terminus 23 of the medial portion, the tip is preferably of a uniform cross section.

As a result of the modified configuration of tip 20, and in particular its lengthened and tapered distal portion, a hinge point will be created within the distal portion, distally beyond aperture shoulder 16, so as to substantially enhance the flexibility of the tip. Further the increased length Y', devoid of the resilient flexible member (typically formed of steel), inserted within aperture 13, provides a sew through region for containing the ends of the breast support frame within the brassiere undercup pocket.

While not intended to be limiting, the following dimensions have been found to provide a particularly advantageous tip construction:

| | |
|---|---|
| X | = 406 inches |
| Y' | = .422 inches |
| A | = .09 inches |
| B | = .046 inches |
| Degree of taper, shown as C | = 9 degrees |
| Proximate end radius, shown as D | = .03 inches |
| Tip taper, as shown by E of FIG. 3 | = 5 degrees |

Figure 6:
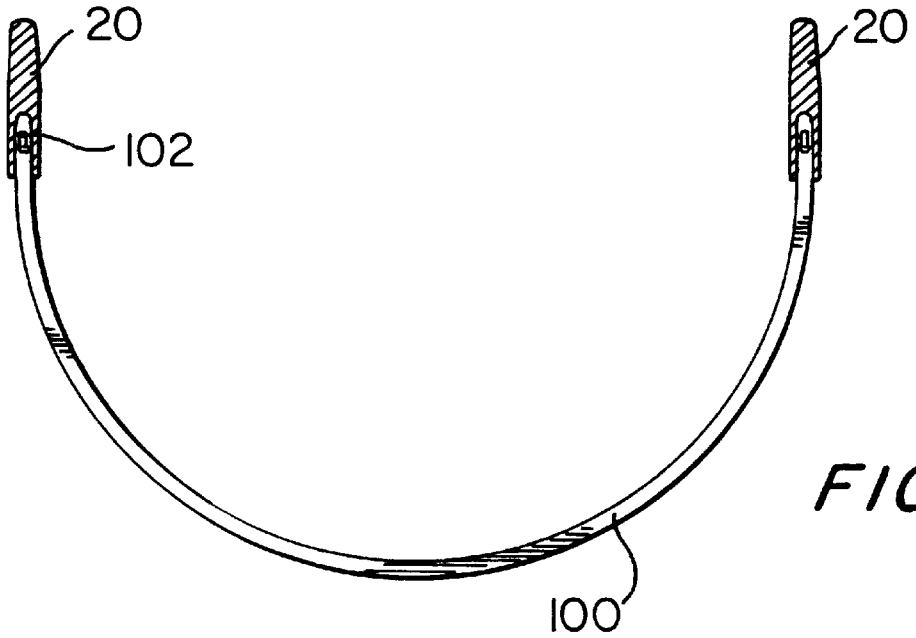
FIG. 6 shows one form of breast support frame incorporating the tip of FIGS. 3–5.
Figure 7:
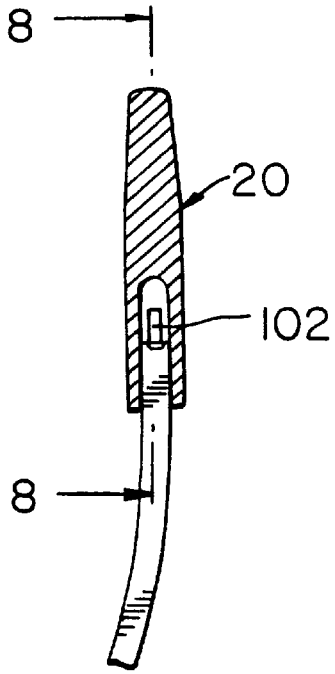
FIG. 7 shows an enlarged detail of the tip end portion of FIG. 6 as shown by the circled area.
Figure 8:
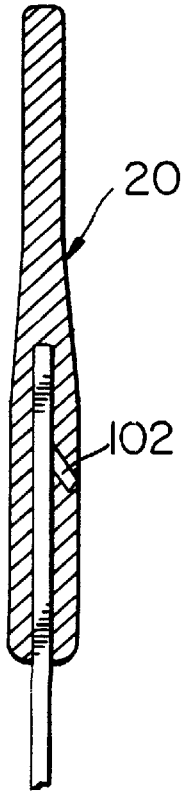
FIG. 8 is a cross sectional view of FIG. 7 as shown by the line 8—8 and looking in the direction of the arrows.

Reference is now made to FIGS. 6–8 which show the tip 20 secured to one form of resilient stiffening member 100. The resilient stiffening member 100 includes a projecting tang 102 at each of its ends. Tang 102 serves as a tip securement means for engaging aperture 15 of tip 20 in the well known manner for providing a secure engagement therebetween.

Figure 9:
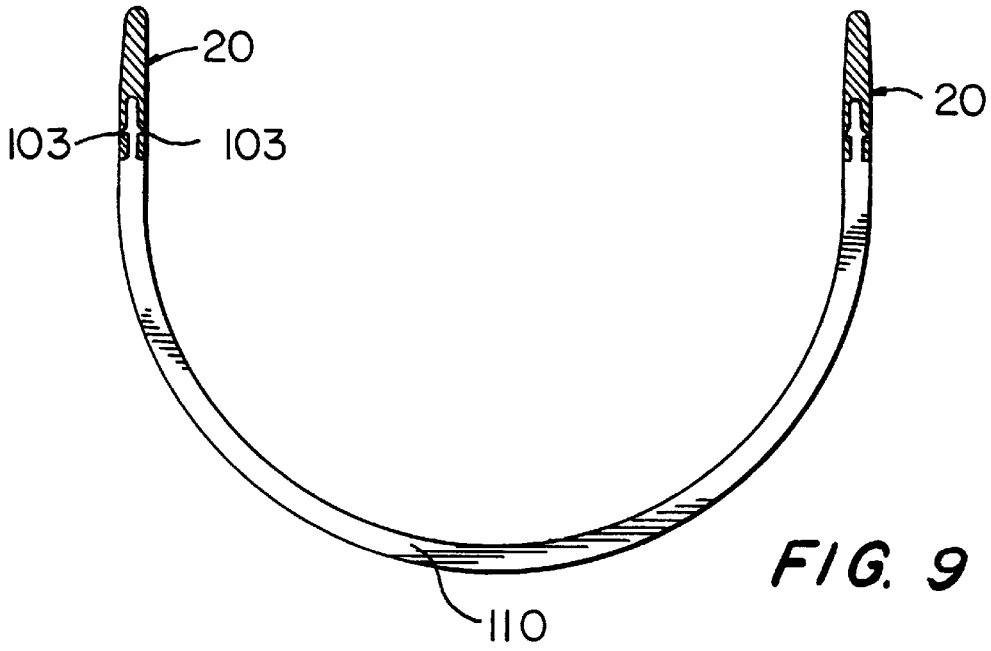
FIGS. 9–11 generally correspond to FIGS. 6–8 but show a modified manner of securing the ends of the resilient stiffening member to the tip of FIGS. 3–5.
Figure 10:
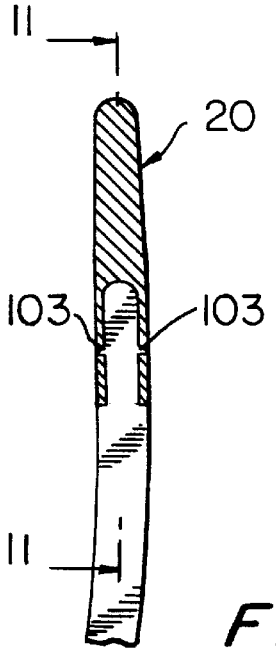
Figure 11:
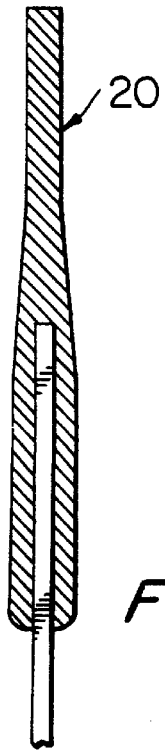

Referring to FIGS. 9–11, resilient stiffening member 110 differs from member 100 in that laterally extending barbs 103 are provided in place of tang 102. Barbs 103 engage tip apertures 17 in the well-known manner to provide a secure engagement therebetween.

It is therefore seen that the present invention provides a breast support frame for brassieres which includes an improved end tip of increased softness and flexibility with respect to prior art tips.

It should be understood that the foregoing description of our invention is intended merely to be illustrative thereof, and other embodiments, modifications, and equivalents may be apparent to those skilled in the art without departing from the spirit and principles, as set forth in the following claims:

We claim:

1. A breast support frame for brassieres comprising:

a resilient stiffening member formed of a first material, and including a generally U-shaped arcuate portion adapted to be positioned within an undercup support pocket, and opposed first and second ends;

each of said ends having a tip securement means for retainingly engaging a separate tip formed of a second material, said second material being softer than said first material;

each of said tips including a tip retention means for cooperatively receiving said tip securement means of said resilient stiffening member for the securement of a tip on each of said ends of said resilient stiffening member;

the proximate end of each of said tips including an aperture of a first length for receiving the end of said resilient stiffening member, said aperture terminating at a medial shoulder at the end of said first length, which defines the limit of longitudinal engagement between the end of said resilient stiffening member and said tip;

said tip including a freely extending distal portion of a second length between the terminus of said aperture and its distal end, with said second length being longer than said first length;

said tip tapering between its proximate and distal ends, with said distal end being of substantially lesser cross sectional thickness than said proximate end.

2. A breast support frame for brassieres comprising:

a resilient stiffening member formed of a first material, and including a generally U-shaped arcuate portion adapted to be positioned within an undercup support pocket, and opposed first and second ends;

each of said ends having a tip securement means for retainingly engaging a separate tip formed of second material, said second material being softer than said first material;

each of said tips including a tip retention means for cooperatively receiving said tip securement means of said resilient stiffening member for the securement of a tip on each of said ends of said resilient stiffening member;

the proximate end of each of said tips including an aperture of a first length for receiving the end of said resilient stiffening member, said aperture terminating at a medial shoulder at the end of said first length, which defines the limit of longitudinal engagement between the end of said resilient stiffening member and said tip;

said tip including a freely extending distal portion of a second length between the terminus of said aperture and its distal end, with said second length being longer than said first length;

said tip tapering between its proximate and distal ends, with said distal end being of substantially lesser cross sectional thickness than said proximate end; and the thickness of material at said distal end being in the order of one-half the thickness of material at said proximate end.

3. A breast support frame for brassieres in accordance with claim 1, wherein the tapering of said tip between said distal and proximate ends initiating within said first length and extending into said second length with said distal portion of a cross sectional thickness along its said entire second length which is less than the cross sectional thickness along said first length.

4. A breast support frame for brassieres in accordance with claim 1, wherein said first material is steel and said second material is plastic.

5. A breast support frame for brassieres in accordance with claim 4, wherein said second material is low density polyethylene.

6. A breast support frame for brassieres comprising:

a resilient stiffening member formed of a first material, and including a generally U-shaped arcuate portion adapted to be positioned within an undercup support pocket, and opposed first and second ends;

each of said ends having a tip securement means for retainingly engaging a separate tip formed of a second material, said second material being softer than said first material;

each of said tips including a tip retention means for cooperatively receiving said tip securement means of said resilient stiffening member for the securement of a tip on each of said ends of said resilient stiffening member;

the proximate end of each of said tips including an aperture of a first length for receiving the end of said resilient stiffening member, said aperture terminating at a medial shoulder at the end of said first length, which defines the limit of longitudinal engagement between the end of said resilient stiffening;

said tip including a freely extending distal portion of a second length between the terminus of said aperture and its distal end, with said second length being longer than said first length;

said tip tapering between its proximate and distal ends, with said distal end being of substantially lesser cross sectional thickness than said proximate end said distal portion being of a cross sectional thickness along its said entire second length which is less than the cross sectional thickness along said first length; and said tip includes a medial taper section which extends through the juncture of said first and second lengths and narrows towards said distal end, said medial taper section including opposed proximate and distal termini, the portion of said tip between the distal terminus of said medial taper section and said distal tip end being of a uniform cross section which is of a thickness in the order of one-half the thickness at said proximate tip end.

7. A breast support frame for brassieres comprising:

a resilient stiffening member formed of a first material, and including a generally U-shaped arcuate portion adapted to be positioned within an undercup support pocket, and opposed first and second ends;

each of said ends having a tip securement means for retainingly engaging a separate tip formed of a second material, said second material being softer than said first material;

each of said tips including a tip retention means for cooperatively receiving said tip securement means of said resilient stiffening member for the securement of a tip on each of said ends of said resilient stiffening member;

the proximate end of each of said tips including an aperture of a first length for receiving the end of said resilient stiffening member, said aperture terminating at a medial shoulder at the end of said first length, which defines the limit of longitudinal engagement between the end of said resilient stiffening member and said tip;

said tip including a freely extending distal portion of a second length between the terminus of said aperture and its distal end, with said second length being longer than said first length;

said tip tapering between its proximate and distal ends, with said distal end being of substantially lesser cross sectional thickness than said proximate end; and said tip is of a first cross sectional thickness at said proximate end, with said first cross sectional thickness extending from said proximate end to a first medial location; and of a second cross sectional thickness between said distal end and a second medial location; and a medial tapered section extends between said first and second medial locations; and said second cross sectional thickness being less than said first cross sectional thickness.

8. A breast support frame for brassieres in accordance with claim 7, wherein said second cross sectional thickness is in the order of one-half of said first cross sectional thickness.

9. A breast support frame for brassieres comprising:

a resilient stiffening member formed of a first material, and including a generally U-shaped arcuate portion adapted to be positioned within an undercup support pocket, and opposed first and second ends;

each of said ends having a tip securement means for retainingly engaging a separate tip formed of a second material, said second material being softer than said first material;

each of said tips including a tip retention means for cooperatively receiving said tip securement means of said resilient stiffening member for the securement of a tip on each of said ends of said resilient stiffening member;

the proximate end of each of said tips including an aperture of a first length for receiving the end of said resilient stiffening member, said aperture terminating at a medial shoulder at the end of said first length, which defines the limit of longitudinal engagement between the end of said resilient stiffening member and said tip;

said tip including a freely extending distal portion of a second length between the terminus of said aperture and its distal end, with said second length being longer than said first length;

said tip tapering between its proximate and distal ends, with said distal end being of substantially lesser cross sectional thickness than said proximate end; and said second length is in excess of one-quarter of an inch.

10. A breast support frame for brassieres comprising:

a resilient stiffening member formed of a first material, and including a generally U-shaped arcuate portion adapted to be positioned within an undercup support pocket, and opposed first and second ends;

each of said ends having a tip securement means for retainingly engaging a separate tip formed of a second material, said second material being softer than said first material;

each of said tips including a tip retention means for cooperatively receiving said tip securement means of said resilient stiffening member for the securement of a tip on each of said ends of said resilient stiffening member;

the proximate end of each of said tips including an aperture of a first length for receiving the end of said resilient stiffening member, said aperture terminating at a medial shoulder at the end of said first length, which defines the limit of longitudinal engagement between the end of said resilient stiffening member and said tip;

said tip including a freely extending distal portion of second length between the terminus of said aperture and this distal end, with said second length being longer than said first length;

said tip tapering between its proximate and distal ends, with said distal end being of substantially lesser cross sectional thickness than said proximate end; and said second length is in the order of 0.4 inches.

11. A breast support frame for brassieres in accordance with claim 7, wherein said second length is in the order of 0.4 inches, and said second cross sectional thickness is in the order of 0.05 inches.

12. A breast support frame for brassieres in accordance with claim 11, wherein said first material is steel and said second material is plastic.

13. A breast support frame for brassieres in accordance with claim 12, wherein said second material is low density polyethylene.

14. A breast support frame for brassieres comprising:

a resilient stiffening member formed of steel, and including a generally U-shaped arcuate portion adapted to be positioned within an undercup support pocket, and opposed first and second ends;

each of said e nd s having a tip securement means for retainingly engaging a separate tip formed of a plastic material;

each of said tips including a tip retention means for cooperatively receiving said tip securement means of said resilient stiffening member for the securement of a plastic tip on each of said ends of said resilient stiffening member;

the proximate end of each of said plastic tips including an aperture of a first length for receiving the end of said resilient stiffening member, said aperture terminating at a medial shoulder at the end of said first length, which defines the limit of longitudinal engagement between the end of said resilient stiffening member and said plastic tip;

said tip including a freely extending distal portion of a second length between the terminus of said aperture and its distal end, with said second length being longer than said first length;

said plastic tip including a medial taper section which extends through the juncture of said first and second lengths and narrows towards said distal end, said medial taper section including opposed proximate and distal termini, the portion of said tip between the distal terminus of said medial taper section and said distal tip end being of a uniform cross section which is of a thickness in the order of one-half the thickness at said proximate tip end.

15. A breast support frame for brassieres in accordance with claim 14, wherein said second material is low density polyethylene.

16. A breast support frame for brassieres in accordance with claim 14, wherein said second length is in excess of one-quarter of an inch.

17. A breast support frame for brassieres in accordance with claim 14, wherein said second length is in the order of 0.4 inches, and said second cross sectional thickness is in the order of 0.05 inches.

18. A breast support frame for brassieres comprising:

a resilient stiffening member formed of a first material, and including a generally U-shaped arcuate portion adapted to be positioned within an undercup support pocket, and opposed first and second ends;

each of said ends having a tip securement means for retainingly engagement a separate tip formed of a second material, said second material being softer than said first material;

each of said tips including a tip retention means for cooperatively receiving said tip securement means of said resilient stiffening member for the securement of a tip on each of said ends of said resilient stiffening member;

the proximate end of each of said tip including an aperture of a first length for receiving the end of said resilient stiffening member, said aperture terminating at medial shoulder at the end of said first length, which defines the limit of longitudinal engagement between the end of said resilient stiffening member and said tip;

said tip including a freely extending distal portion of a second length between the terminus of said aperture and its distal end, with said second length being longer than said first length;

said tip tapering between a medial location said medial shoulder and proximate end, towards said distal end, with said distal end being of substantially lesser cross sectional thickness than said proximate end.

* * * * *